US005718468A

United States Patent [19]

Qureshi et al.

[11] Patent Number: 5,718,468

[45] Date of Patent: Feb. 17, 1998

[54] DOOR HANDLE MODULAR RETURN SPRING CAGE ASSEMBLY

[75] Inventors: Khurshid A. Qureshi; Bruce P. Eagan; Rocco A. Carestia, all of Colorado Springs; William S. Massey, Yoder, all of Colo.; Joseph G. Matulich, San Mateo, Calif.

[73] Assignee: Schlage Lock Company, San Francisco, Calif.

[21] Appl. No.: 738,406

[22] Filed: Oct. 25, 1996

Related U.S. Application Data

[63] Continuation of Ser. No. 455,793, May 31, 1996, abandoned.

[51] Int. Cl.[6] ..... E05B 1/00

[52] U.S. Cl. ..... 292/347; 292/357

[58] Field of Search ..... 292/336.3, 347, 292/353, 356, DIG. 30, DIG. 61, 336.5, 357; 70/207, 224, DIG. 32, DIG. 33, DIG. 36, DIG. 55, 216, 218, 221, 222

[56] References Cited

U.S. PATENT DOCUMENTS

| | | | |
|---|---|---|---|
| 2,119,866 | 6/1938 | Milligan | 70/216 |
| 2,729,485 | 1/1956 | Schlage | 292/1 |
| 2,801,869 | 8/1957 | George | 70/216 |
| 3,207,541 | 9/1965 | Bartlett | 70/219 |
| 3,212,806 | 10/1965 | Russell et al. | 292/336.3 |
| 4,671,089 | 6/1987 | Fleming et al. | 70/452 |
| 4,911,489 | 3/1990 | Hansen et al. | 292/336.3 |
| 4,998,760 | 3/1991 | Nixon et al. | 292/347 |

FOREIGN PATENT DOCUMENTS

| | | | |
|---|---|---|---|
| 480364 | 2/1938 | United Kingdom | 292/347 |

*Primary Examiner*—Steven N. Meyers
*Assistant Examiner*—Gary Estremsky
*Attorney, Agent, or Firm*—Robert F. Palermo; Michael H. Minns

[57] ABSTRACT

A modular return spring cage assembly for door lock handles, consists of a door lock mounting chassis member having two opposed faces, at least one face having two opposed arcuate channels forming a circular groove in the face. The groove has two split diametrically opposed spring bases each formed by two substantially equal spring stops projecting from radially outer and radially inner walls of the groove. Two compression springs are slidably disposed within the channels and have length such that a slight compression is required to fit the springs between the split spring bases. An arrangement for transmitting torsional motion between a door handle and the springs, and for limiting rotary motion of the handle is included. A provision for positively retaining the springs and the torsional motion transmission arrangement on the mounting chassis member completes the modular assembly. When so assembled, the spring cage module can be easily installed in or removed from a door preparation; and, because of its modularity, it may be designed to be reversible to provide enhanced tamper resistance.

2 Claims, 3 Drawing Sheets

DOOR HANDLE MODULAR RETURN SPRING CAGE ASSEMBLY

This is a continuation of U.S. patent application Ser. No. 08/455,793 filed on May 31, 1996 by K. Qureshi, et al., now abandoned, and assigned to the assignee of the present invention.

BACKGROUND OF THE INVENTION

This invention relates generally to door hardware and more particularly to an apparatus for supporting, guiding, and protecting door handle return springs and to simplify their installation on the door hardware.

In response to the needs of the handicapped population and to the Americans with Disabilities Act (ADA) legislation, commercial building owners are required to provide locksets which can be operated by disabled persons. Most commonly, this is done by installing lever operated locksets in place of those with knob style handles. Levers can be easily pressed without grasping; they provide increased mechanical advantage; they generally require no power assist or power connections; and, in many cases, they can be substituted for knobs without changing the whole lockset.

Most door locksets have decorative (or cosmetic) trim roses, surrounding the spindle of the handle, which conceal the inner mounting hardware and give the mounted lock a finished appearance. These are commonly fastened, by screws, spring clips and slots, or some combination thereof, to plates which form the external portions of the lockset mounting chassis. Within the chassis, in addition to the latch operating components, there is some arrangement of springs and levers for extending the latch and for returning the knob or handle to a resting (or parked) position.

In knob operated cylindrical locksets, the latch return springs will usually suffice for also returning the knob. This is because the symmetrical shapes of knobs and their resulting balanced mass distribution only require the return springs to overcome friction within the lock mechanism. However, for the same lock equipped with lever handles, the springs also must overcome the lever overhang and the weight imbalance and may not be strong enough to prevent sagging and droop of the levers. This gives an unattractive appearance and indicates an inadequacy of design which must result in premature failure of the return springs.

Part of the cause of this inadequacy is the space constraints within the door preparation and the mounting chassis which limit the radial extent of return levers and arms upon which the return springs must act. This results in low mechanical advantage for the return springs and, for any given spring size, limits the return force capacity. Thus, a heavy lever will begin to sag after a relatively short service life, due to weakening of the springs. Although very stiff springs could prevent lever sag, they cannot be applied to door levers because of the necessity for operability of the levers by children and handicapped persons.

Finally, whatever lever return scheme is used, it must be reasonably simple to install so that labor costs for new installations and retrofits will not be unduly high. Many return spring systems are relatively complicated in that they include many parts, have limited space and access to the parts, and require a high degree of skill to install. Any new return spring system should, as a minimum, address the limitations enumerated above. This is important in order to enable building owners to upgrade existing buildings and to design new buildings for easy access in accord with the requirements of the ADA. Lever handles meet the requirements for accessibility, but they do not always provide the simplicity of structure and installation described as desirable above.

The foregoing illustrates limitations known to exist in present door handle return spring systems for door locksets. It would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a modular return spring cage assembly for door lock handles, comprising a door lock mounting chassis member having two opposed faces, at least one face having two opposed arcuate channels forming a circular groove in the face, the groove having two split diametrically opposed spring bases each formed by two substantially equal spring stops projecting from radially outer and radially inner walls of the groove; two compression springs slidably disposed within the channels and having length such that a slight compression is required to fit the springs between the split spring bases; an arrangement for transmitting torsional motion between a door handle and the springs, and for limiting rotary motion of the handle; and means for retaining the springs and the means for transmitting torsional motion on the mounting chassis member.

The foregoing and other aspects will become apparent from the following detailed description of the invention when considered in conjunction with the accompanying drawings.

DETAILED DESCRIPTION

Figure 1:
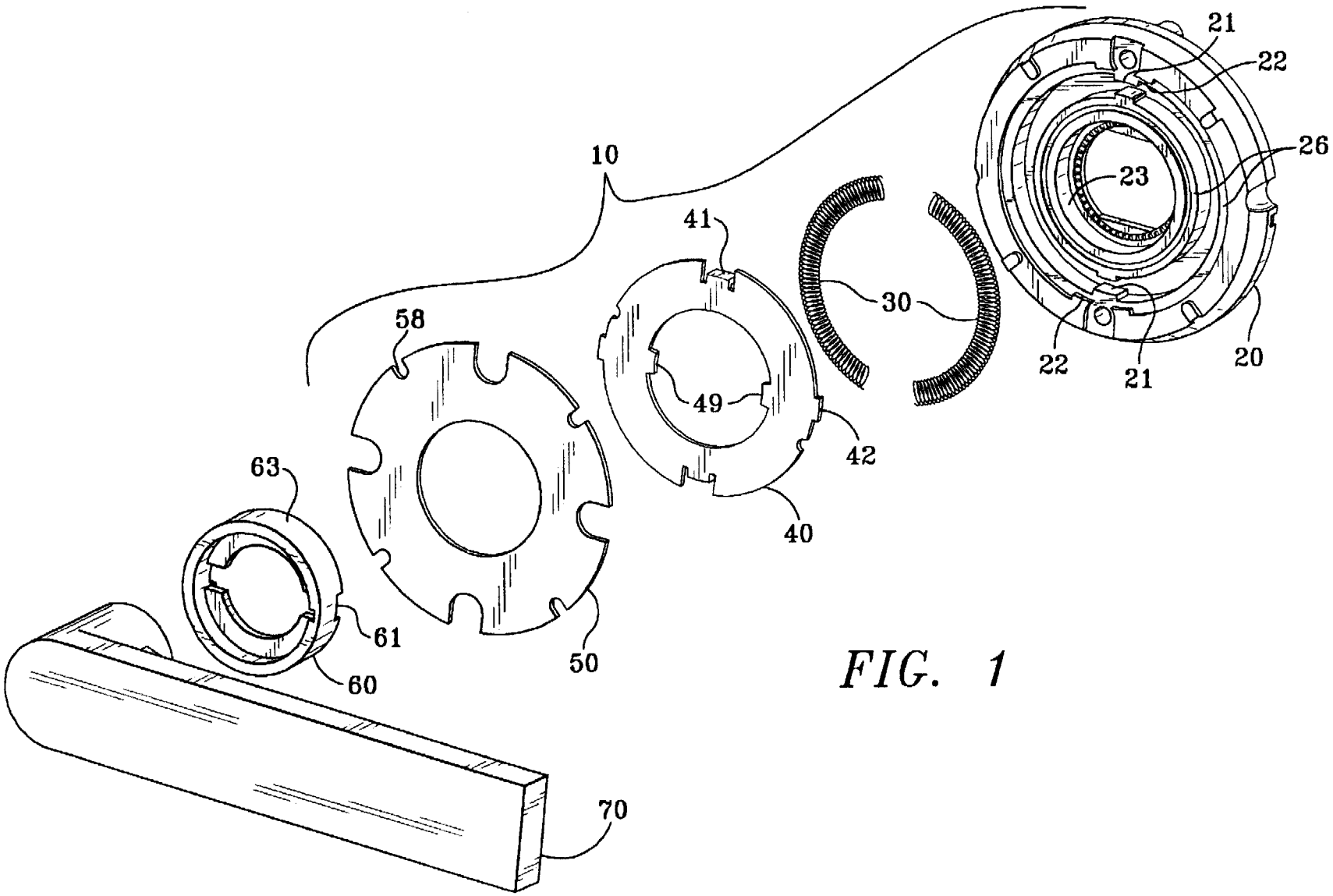
FIG. 1 is a schematic exploded perspective view of a door lever handle and the components of the modular return spring cage assembly of the present invention looking toward the door face.

FIG. 1 shows a door handle 70 (in this case a lever) together with a driver 60 for driving a spindle and a torque plate 40. The driver 60 is shown as a separate item from the handle 70, but it may be made as part of the handle 70 if desired. The handle/driver 70/60 operates together with the spring cage module 10 as described herein. The module 10 comprises a mounting chassis member 20 with two arcuate spring guide channels(25 in FIGS. 2 & 3), a pair of compression springs 30, a torque plate 40, and a fire plate 50. Driver 60 has slots 61 for engaging tabs 49 of torque plate 40 for causing plate 40 to rotate with driver 60.

Figure 3:
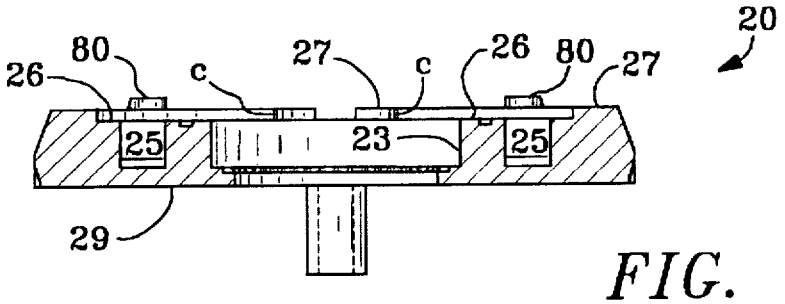
FIG. 3 is a elevational cross sectional view of the mounting chassis member showing greater detail of the mounting chassis member.
Figure 4:
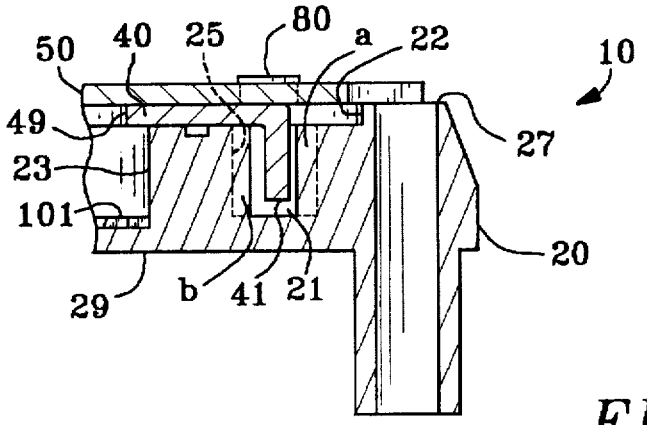
FIG. 4 is a fragmentary elevational cross sectional view of the modular spring cage assembly showing greater detail of assembly and the interrelationship of the parts.
Figure 5:
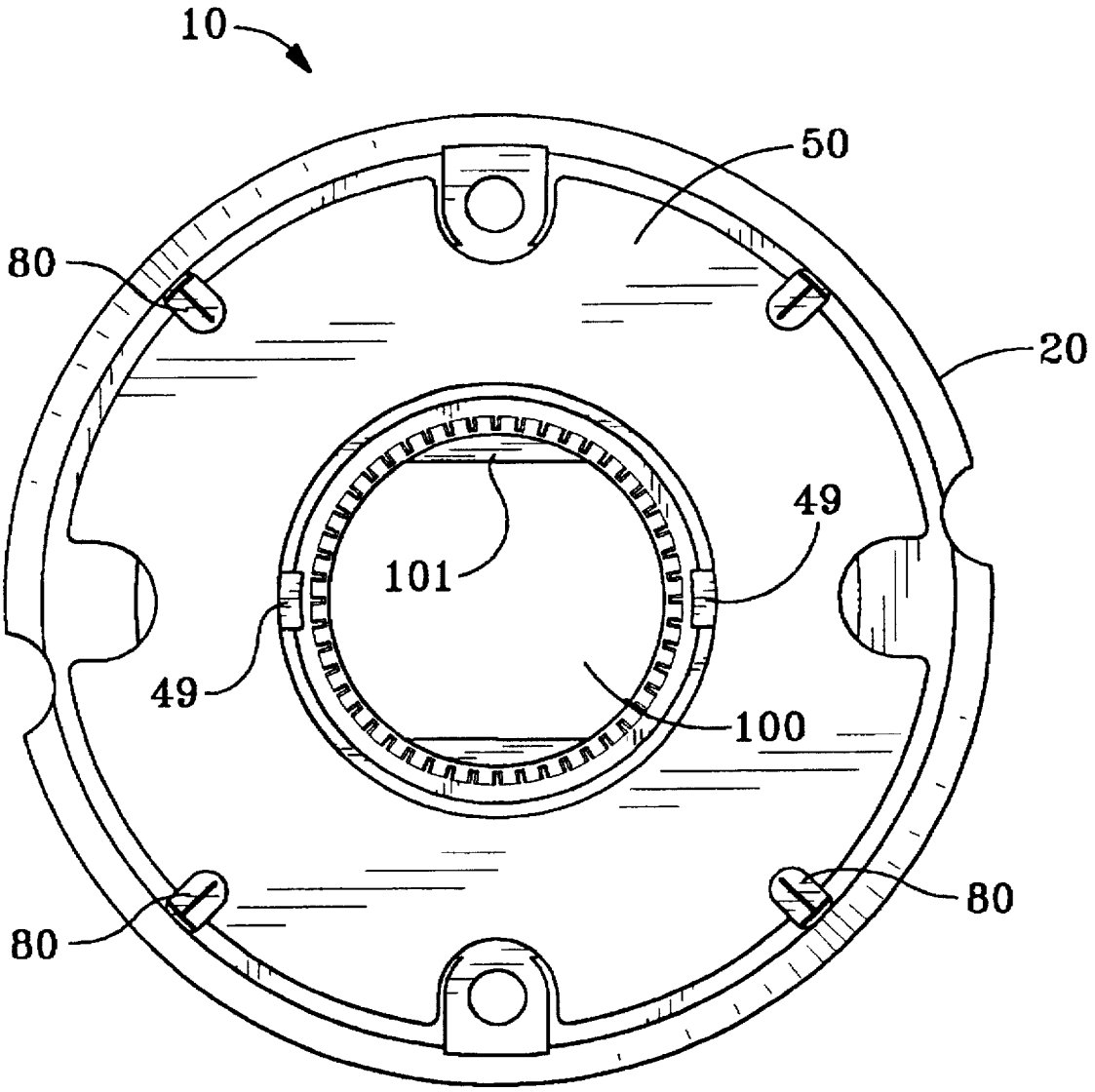
FIG. 5 is a plan view of the modular spring cage assembly in its preferred embodiment.

Torque plate 40 has radially outwardly extending tabs 42 and axially extending tabs 41 for limiting rotary motion by striking the edges of limiter projections 22 of mounting chassis member 20, and for reaching into slots 21 of the circular groove to displace compression springs 30, respectively, whenever lever 70 and its driver 60 are turned. Slots 21 are formed by the spring stops ("a" & "b" in FIGS. 2 & 4) projecting radially outwardly and radially inwardly from the inner and outer walls of the channels (25 in FIGS. 2 & 3). A fire plate 50 is shown, also. This prevents flame travel through the lock from one side to the other, in the event of a fire; but it also may be used to retain the torque plate 40 and compression springs 30 in proper alignment against mounting chassis member 20 without interfering with their motion during operation of the door lock. This is the preferred method for such retention, but it would also be feasible to provide the same function with any of a number of well known torque plate retention means (not illustrated) which would still permit unimpeded rotation of the torque plate.

Figure 2:
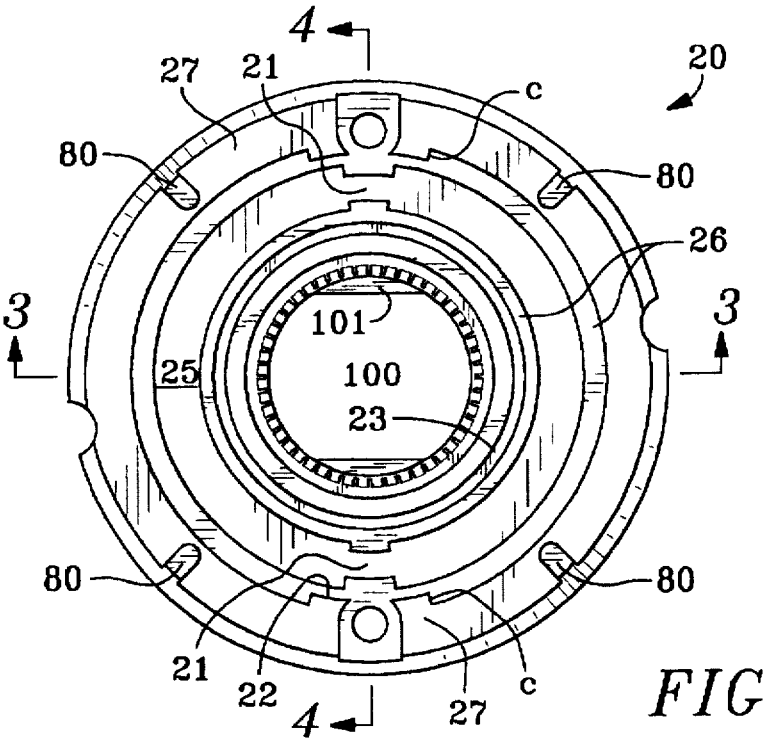
FIG. 2 is a schematic front view of the mounting chassis member showing details of the arcuate channels which form the circular groove together with other novel features of the invention.

FIG. 2 shows a front view of the mounting chassis member 20. In this case, front refers to the side of member 20 which faces outwardly from the door. It should be noted that, because of its modular design, the present invention could as well be reversed so that the view of FIG. 2 would be a rear view instead. One advantage of the reversed embodiment is that the back side of the mounting chassis member 20 may be designed to present a flat and solid surface which has an enhanced resistance to tampering and damage when installed. The method of attachment of the mounting housing member 20 to the lockset and the door is not illustrated or discussed in detail; because such attachment schemes are well known in the art, and any of such schemes may be used. However, for the highest strength and security, the preferred attachment method uses through bolts between mounting chassis members on both sides of the door, the bolts passing through the door outside the door lock preparation cavity. In addition, castellated nuts are threaded onto both sides of the spindle housing which projects from the lock housing through the spindle ports 100 of chassis members 20 on both sides of the door. The result is a very strong lock assembly installation.

The preferred embodiment of the module 10 can be best understood by reference to FIGS. 1–5, as different features are apparent in each Figure. Mounting chassis member 20 is a disc-like body with a circular groove on at least one side formed by two channels 25 connected by two slots 21 in two diametrically opposed spring bases defined by spring stops "a" and "b" projecting from the walls of channels 25. Member 20 has a first surface 27 on one face and a second surface 29 on an opposite face. A third surface 26 bounds channels 25 and is recessed below first surface 27. Two diametrically opposed limiter projections 22 are coplanar with first surface 27 and obstruct an outer portion of third surface 26 to provide bi-directional limits to rotary motion of torque plate 40 along third surface 26. Edges "c" of limiter projections 22 act as stops against which tabs 42 of torque plate 40 strike when the rotational limit is reached.

The two diametrically opposed tabs 41 of torque plate 40 extend axially from the torque plate into slots 21 of chassis member 20. When the torque plate 40 is rotated in either direction, tabs 21 compress springs 30, and, when released, the springs 30 return the torque plate 40 to its resting position by pushing tabs 41 back into slots 21. Using two springs 30 provides the advantage of doubling the return force available to prevent sagging of the handle 70, of halving the wear and tear on the return compression springs 30, of permitting use of stronger springs, and of providing redundancy to permit continued operation even if one of the springs 30 fails. This allows repairs to be made without waiting for complete failure of the return function. Torque plate 40 rotates in response to rotation of driver 60 by means of tabs 49 which engage with slots 61 of the driver member. Thus, when the handle 70 is turned, driver 60 turns causing torque plate 40 to turn and springs 30 to be compressed. When the handle is released, the springs 30 expand, push against tabs 41 to return the torque plate 40 to its resting position with tabs 41 in slots 21. This returns driver 60 and handle 70 to their resting position by means of the rotary interaction of tabs 49 with slots 61.

Chassis member 20 also has a spindle port 100 at its center for accepting a spindle housing. A fourth surface 101 surrounds port 100 and is bounded by a cylindrical wall 23, which acts as a support and guide for rotary motion of driver 60 and handle 70. Outer surface 63 of driver 60 receives rotary bearing support from wall 23 surrounding surface 101 of chassis member 20.

Fire plate 50 is the preferred means for retaining all components in their modular package; because it prevents flame travel through the door lock and door preparation cavity while providing a low friction retention surface against which torque plate 40 can rotate. The springs 30 are retained by torque plate 40. The fire plate 50 is secured to chassis member 20 against surface 27 by placing slots 58 over projections 80 of chassis member 20 and expanding or staking the projections to secure the plate to the member. This attachment could also be made by threaded fasteners, tongue and groove turnlocks, riveting, welding, or other known joining techniques; but, because of its simplicity, staking is preferred. Other retention devices could be used, such as a plurality of separate low friction torque plate hold down tabs, arrayed around the edge of chassis member 20, or an overhanging lip formed on the inner edge of surface 27 of chassis member 20. In such cases, the fire plate 50 is not needed as long as chassis member 20 is designed with no direct flame paths.

Once assembled, the door handle modular return spring cage assembly is compact, durable, damage resistant, and, because of these properties, it is easy to handle and to install. The modular assembly may also include mounting provisions for trim roses or other ornamental devices.

What is claimed is:

1. A modular return spring cage assembly for door lock handles, comprising:

a door lock mounting chassis member having two opposed faces, at least one face having two opposed arcuate channels forming a circular groove in said face, said groove having two split diametrically opposed spring bases each formed by two substantially equal spring stops projecting from radially outer and radially inner walls of the groove;

two compression springs slidably disposed within said channels and having length such that a slight compression is required to fit said springs between said split spring bases;

means for transmitting torsional force between a door handle and said springs, and for limiting rotary motion of said door handle, comprising a substantially circular torque plate consisting of an annular disc with one face in contact with said mounting chassis member, an inner edge having at least two tabs projecting radially inwardly from said inner edge and engaging slots of a handle actuated driver, an outer edge having at least two tabs projecting radially outwardly from said outer edge for striking rotation limiter projections on said mounting chassis member, and two tabs projecting axially from said one face in contact with said mounting chassis member into slots in two spring bases in said groove of said mounting chassis member for compressing said springs and for being returned to a resting position in said slots in said spring bases by said springs; said disc being rotatably retained on said mounting chassis member; and means for retaining: a) said springs, and b) said means for transmitting torsional force on said mounting chassis member, said means for retaining comprising: a substantially circular annular fire plate disc attached to said mounting chassis member, said fire plate disc having an open center for passage of said handle driver therethrough; and means for attaching said fire plate disc to said mounting chassis member whereby the torque plate is retained between the chassis member and the torque plate.

2. The modular return spring cage assembly of claim 1, wherein the means for attaching said fire plate disc to said mounting chassis member comprises: a plurality of projecting studs on said mounting chassis member; and a plurality of holes in said disc, near the periphery of said disc, for receiving said projecting studs on said mounting chassis member, said studs being deformed, thereby attaching said fire disc to said mounting chassis member.

* * * * *